United States Patent [19]

Selleslags

[11] 4,246,709

[45] Jan. 27, 1981

[54] IDENTIFICATION CARRYING MEANS

[75] Inventor: Frank K. A. Selleslags, Haosrode, Belgium

[73] Assignee: N.V. Raychem S.A., Kessel, Belgium

[21] Appl. No.: 875,890

[22] Filed: Feb. 7, 1978

[30] Foreign Application Priority Data

Oct. 5, 1977 [GB] United Kingdom ..... 41407/77

[51] Int. Cl.[3] ..... A44C 3/00

[52] U.S. Cl. ..... 40/2 R; 40/310; 40/158 R; 40/316; 40/594

[58] Field of Search ..... 40/306, 310, 23 R, 316, 40/158, 2 R, 159

[56] References Cited

U.S. PATENT DOCUMENTS

| | | | |
|---|---|---|---|
| 2,110,768 | 3/1938 | Kellog | 40/10 R |
| 2,929,161 | 3/1960 | Kuyk | 40/23 R |
| 3,370,365 | 2/1968 | Vosbikian | 40/10 R |
| 3,433,688 | 3/1969 | Staats et al. | 402/80 R |
| 3,733,002 | 5/1973 | Fujio | 40/310 X |
| 3,862,026 | 7/1974 | Bevan | 40/10 B |
| 4,004,705 | 1/1977 | Fujio | 40/310 X |
| 4,019,272 | 4/1977 | Kerz | 40/23 R X |
| 4,064,645 | 12/1977 | Wood | 40/159 |

FOREIGN PATENT DOCUMENTS

| | | | |
|---|---|---|---|
| 851053 | 10/1960 | United Kingdom | 40/2 R |
| 915779 | 1/1963 | United Kingdom | 40/2 R |
| 1414158 | 11/1975 | United Kingdom | 40/2 R |

*Primary Examiner*—F. Barry Shay
*Assistant Examiner*—W. J. Contreras
*Attorney, Agent, or Firm*—Lyon & Lyon

[57] ABSTRACT

A heat-curlable identification carrying means comprising a transparent sheet, and an adhesive backing layer for attaching the means to a substrate, the means optionally having an intermediate sheet bearing or suitable for bearing indicia.

7 Claims, 2 Drawing Figures

IDENTIFICATION CARRYING MEANS

This invention relates to identification carrying means, carrying identifying indicia, or capable of carrying such indicia, and to dimensionally heat unstable articles for use in such means.

As used in this specification, the term "identification carrying means" includes means containing an element having a surface bearing indicia or capable of bearing such indicia, and also means not having the said element.

It is frequently necessary to identify one or all of the electrical cables, or other conduits, for example, pipelines in an oil refinery, in complex installations containing them. If a cable has a lead sheath, as was formerly generally the case, it could be identified simply by punching letters or numbers in the sheath. With the more modern polyethylene jacketed cables, and plastics pipes, this is no longer possible, and it has instead been proposed to apply "marker sleeves" bearing indicia to the cable. These suffer from the disadvantage, however, that a large stock of sleeves bearing the letters and numbers has to be carried, since each sleeve normally bears only a single letter or number, the coding for the cable being made up of a number of sleeves. Alternatively, the whole code may be imprinted on a single sleeve, but this also has disadvantages since a permanent marking (which of course is always desirable and in many cases, for safety reasons, essential) can only be imparted to the sleeves, which are of a polymeric material, using specially designed apparatus.

Furthermore, the sleeves, in general, may only be applied to the cable during installation, since they have to be slipped over a free end.

The present invention provides an identification carrying means, which curls on heating, preferably only about a single axis or only about a number of parallel axes, comprising a first, transparent, sheet, a second sheet, adapted to carry indicia, or carrying one or more indicia, and a third, adhesive, layer bonded, directly or indirectly, to the first sheet, along portions only of the surface of the first sheet which becomes concave on curling, and preferably bonded along edge regions of the first sheet, which edges become curved on curling of the sheet about the single axis or parallel axes. Preferably, the third layer is a sheet which extends over substantially the whole area of the first sheet, and is conterminous therewith, but is bonded thereto only at the said edges, the second sheet being capable of being interposed, or removed from, between the first and third sheets. The invention also provides a method of identifying a body employing the means.

The adhesive layer may be a sheet, or it may be a coating on an additional sheet, which has the advantage that contact between the second sheet and the adhesive may be avoided if desired. The additional sheet may be bonded to the first sheet by any suitable method, the adhesive layer being on the face of the additional sheet remote from the first sheet.

The invention also provides an identification carrying means as defined above with the second sheet omitted.

The present invention also provides a method of identifying a body having a curved surface, which comprises recording identifying indicia on a second sheet, interposing the second sheet between a first transparent sheet having a first opposed pair of edges and a second opposed pair of edges, the first sheet being heat-curlable, preferably so that the second opposed pair of edges retain substantially their initial configuration, and a third, adhesive, layer, having first and second opposed pairs of edges, corresponding to those of the first sheet, the third layer being bonded to the first at portions only, advantageously along lines parallel to and preferably in the proximity of the first opposed edges, whereby the second sheet may be interposed between the first sheet and the third layer, the third layer being on the face of the first sheet that becomes concave on curling, applying the assembly of first, second and third sheets and layer to the curved surface of the body, with the first sheet outwards and heating the first sheet to cause it to curl around the body, and advantageously to cause the adhesive to stick to the body.

The first sheet is advantageously curlable, and is advantageously formed of a thermoplastic material, preferably a crosslinked material, that has been deformed from a curled configuration to a planar configuration and is capable of retaining its planar configuration until heated, when it reverts, or attempts to revert, to its original curled configuration, i.e., it is stable at room temperature in the planar configuration. The sheet may be made, for example, by extruding a tube of thermoplastic material, crosslinking it if desired or required, slitting the tube longitudinally (once or more, depending on the angle that the final sheet is to subtend) flattening the slit tube into a planar form, heating while maintaining or imposing planarity (for example, by positioning it between two plates in compression), at least to a suitable temperature, and cooling it while maintaining planarity.

The web, or slit tube, may be made planar before or after cutting into lengths corresponding to the width of the sheets in use, as desired.

The "suitable temperature" referred to above will depend on the material of the sheet. In the case of a crystalline, crosslinked, material, or a material having such a high molecular weight or other property that it behaves as if it were crosslinked, the minimum temperature is the crystalline melting point. In the case of a non-crystalline material, which may or may not be crosslinked, but preferably is, the minimum temperature is the softening temperature or range. The procedure may be any of those used or described in the literature for imparting the property of heat-recovery to a thermoplastic material, and the appropriate temperatures are well-known to those skilled in the art of heat-recoverable materials.

Further methods of making the first sheet are those described in British Pat. Specifications Nos. 1,383,556 and 1,392,212, the disclosures of which are incorporated by reference herein. Briefly, these specifications describe a sheet, the material of one face of which has a greater tendency to shrink on heating than that of the other face. Therefore, on heating, the sheet curls, with the face having the greater tendency to shrink in the inside of the curl.

A further method of imparting curlability to a material is to crosslink a sheet or web of thermoplastic material while it is in a curved configuration, for example, by irradiation or initiation of a chemical crosslinking agent that has not reacted during initial shaping of the material into the sheet or web. If the web is to be crosslinked by radiation, it may be passed over rollers of suitable diameter while being irradiated; if a web is passed through a roller train transverse to the radiation beam, its curvature will alternate between that desired and the opposite curvature, but the rollers will screen the radiation except where it is either planar or has the desired curvature.

The second sheet may be of any material, provided it is not too severely damaged by the heat necessary to cause the first sheet to curl, and provided it is capable of accepting identification marks by the chosen method. As will be appreciated, this is a great advantage of the assembly of the present invention since, although the assembly may be, and desirably is, provided to a user with a second sheet, for example a sheet of paper, already inserted, the user may supply the sheet, of a material suitable to withstand the particular environment to which it will be exposed after installation. In such cases, although not preferred, the third, adhesive, layer or sheet, need not extend across the whole width of the first sheet, but the second sheet may be positioned so that part or all of it is in contact with the body to be identified, the adhesive of the third sheet being positioned on both or all sides of the second sheet, with the first sheet covering the whole, after installation, being bonded to the body by the adhesive of the third sheet.

The third, adhesive, layer or sheet is advantageously a heat activatable, or hot melt adhesive, for example those referred to in British Patent Application No. 21467/76, German Offenlegungschrift No. 27 23 116.1, and British Pat. No. 1,440,810, and in the documents referred to therein, the disclosures of all of which are incorporated herein by reference. The operating temperature of the adhesive is, of course, desirably chosen to be such that the adhesive is rendered functional at the temperature at which the first sheet curls. It will be appreciated that the assembly of the present invention may be supplied to the customer in web form, an appropriate length being cut from the web to provide the sheet. Accordingly, it will also be appreciated that, as the web is conveniently supplied in a roll, the sheet as supplied need not be planar.

One form of identification carrying means constructed in accordance with the invention will now be described, by way of example only, with reference to the accompanying drawings, in which.

Figure 1:
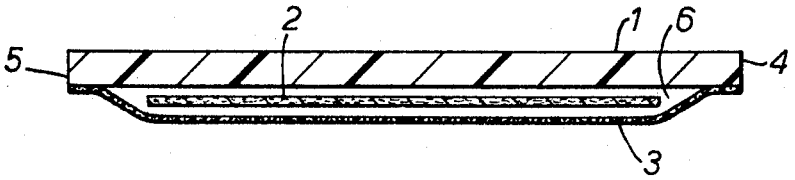
FIG. 1 is a cross-section through an assembly before installation.

Referring now more especially to FIG. 1, a transparent crosslinked thermoplastic heat-curlable sheet 1 has bonded at its opposite edges 4, 5 a sheet 3 of hot melt adhesive material, the bonding being such as to provide a space 6 between the sheets 1 and 3 of sufficient dimensions to allow a sheet 2 of paper to be interposed between them, or removed so that indicia may be marked thereon.

The sheet 1 is heat-curlable such that its edges 4, 5 become curved, the sheet 1 curling toward the sheets 2 and 3, the cross-section shown remaining generally straight.

Figure 2:
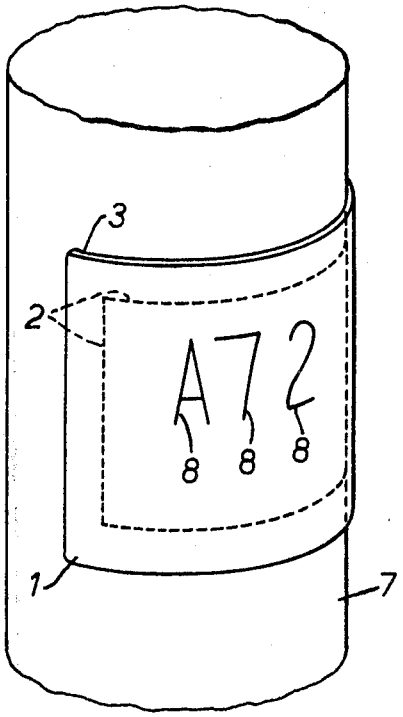
FIG. 2 shows the means installed on a cable.

Referring now to FIG. 2, the assembly is shown installed on a cable 7. The sheet 2 (the edges of which are shown by a broken line) carries indicia 8, which are clearly visible through the transparent sheet 1, while the assembly is firmly adhered to the surface of the cable 7 by the adhesive 3.

The assembly may be prepared and installed as described in the following example. A transparent polyethylene tube of diameter about 100 mm was extruded, crosslinked, longitudinally split and cut to provide a sheet of length 170 mm and width 130 mm, the width corresponding to the axial direction of the original tube. The sheet was heated to 130° C. for 5 minutes between two flat plates and allowed to cool while maintained between the plates. A sheet of hot melt adhesive of the same dimensions as the crosslinked polyethylene sheet was bonded to the first sheet for a width of about 10 mm at each edge of the sheets, leaving a space between into which space was inserted a label.

The jacket of a 60 mm diameter cable was cleaned, abraded and preheated, and the assembly placed on the cable, with the short side of the cable parallel to the cable axis, and the adhesive sheet in contact with the cable. The assembly was then heated until it curled around the cable, and, with a gloved hand, the air trapped under the sheets pressed out as required. A firmly attached identification means, with clearly visible indicia, was formed.

I claim:

1. Identification carrying means that curls on heating, comprising a transparent sheet that curls on heating and an adhesive layer bonded thereto along portions only of the surface of the transparent sheet, which surface becomes concave on heating, the areas of bonding allowing the insertion of a further sheet between the transparent sheet and the adhesive layer, wherein the transparent sheet is formed of a crosslinked thermoplastic material that has been deformed from a curled configuration to a room-temperature stable planar configuration.

2. Identification carrying means that curls on heating, comprising a transparent sheet that curls on heating and an adhesive layer bonded thereto along portions only of the surface of the transparent sheet, which surface becomes concave on heating, the areas of bonding allowing the insertion of a further sheet between the transparent sheet and the adhesive layer, wherein the adhesive is heat-activatable and the temperature at which the transparent sheet curls being a temperature at which the adhesive layer becomes functional.

3. Identification carrying means as claimed in claim 1 or 2, wherein the adhesive layer is conterminous with the first sheet and is bonded thereto only at the edges that become curved on heat-curling.

4. Identification carrying means as claimed in claim 1 or 2, wherein the adhesive layer is conterminous with the first sheet and is bonded thereto only at the edges that remain flat on heat-curling.

5. Substantially flat identification carrying means for application to a curved surface comprising:

a substantially flat transparent sheet which upon heating curls about a single axis to become concave;

a heat-activatable adhesive layer bonded to selected portions of only one of the surfaces of the transparent sheet, said surface being the surface which becomes concave upon curling, the adhesive being activatable at a temperature at which the transparent sheet curls; and a pocket between the transparent sheet and the adhesive layer wherein the areas of bonding allow the insertion of identification means into the pocket.

6. Identification carrying means as claimed in claim 5 wherein said selected portions at least include the edges of the transparent sheet which become concave on curling.

7. Identification carrying means as claimed in claim 5 wherein the adhesive layer is conterminous with the transparent sheet and is bonded thereto at the edges of the transparent sheet that become concave on heating.

* * * * *